US007650877B2

(12) United States Patent
Thalberg et al.

(10) Patent No.: US 7,650,877 B2
(45) Date of Patent: Jan. 26, 2010

(54) DEVICE FOR PRECONDITIONING OF COMBUSTION AIR

(75) Inventors: Anders Thalberg, Hafslundsoy (NO); Terje Gudmundsen, Oslo (NO)

(73) Assignee: Magnetic Emission Control AS, Koppang (NO)

( * ) Notice: Subject to any disclaimer, the term of this patent is extended or adjusted under 35 U.S.C. 154(b) by 136 days.

(21) Appl. No.: 10/571,676

(22) PCT Filed: Sep. 12, 2003

(86) PCT No.: PCT/NO03/00316

§ 371 (c)(1),
(2), (4) Date: Mar. 13, 2006

(87) PCT Pub. No.: WO2005/026521

PCT Pub. Date: Mar. 24, 2005

(65) Prior Publication Data

US 2007/0051347 A1 Mar. 8, 2007

(51) Int. Cl.
*F02M 27/00* (2006.01)

(52) U.S. Cl. ..... 123/539

(58) Field of Classification Search ..... 123/536–539; 210/222, 695

See application file for complete search history.

(56) References Cited

U.S. PATENT DOCUMENTS 4,308,847 A 1/1982 Ruizzo, Jr.
4,461,262 A * 7/1984 Chow ..... 123/536
4,755,288 A * 7/1988 Mitchell et al. ..... 210/85
4,808,306 A 2/1989 Mitchell et al.
5,271,369 A * 12/1993 Melendrez ..... 123/538
6,041,763 A * 3/2000 Akyildiz ..... 123/538
6,178,954 B1 1/2001 Kim
7,331,336 B2 * 2/2008 Hricak ..... 123/536
2002/0074064 A1 6/2002 Kane
2003/0209233 A1 * 11/2003 Thalberg et al. ..... 123/539

FOREIGN PATENT DOCUMENTS

CN 1081495 A 2/1994
CN 2338499 Y 9/1999
WO WO 03/008341 1/2003

* cited by examiner

*Primary Examiner*—M. McMahon
(74) *Attorney, Agent, or Firm*—Young & Thompson

(57) ABSTRACT

A device for pre-conditioning combustion air at an inlet path to a combustion chamber, in which the inlet includes a set of two or more magnetic fields arranged along the inlet path. Each magnetic field has a corresponding north pole and a south pole and a magnetic moment vector extending from the south pole portion to the north pole. The magnetic moment vectors are arranged mainly perpendicularly with respect to the inlet path; the magnetic moment vectors are distributed consecutively along the inlet path; the second or consecutive magnetic field are arranged with the second or consecutive magnetic moment vector's pole with the opposite pole adjacent to the inlet path relative to the first or preceding magnetic moment vector's pole.

18 Claims, 14 Drawing Sheets

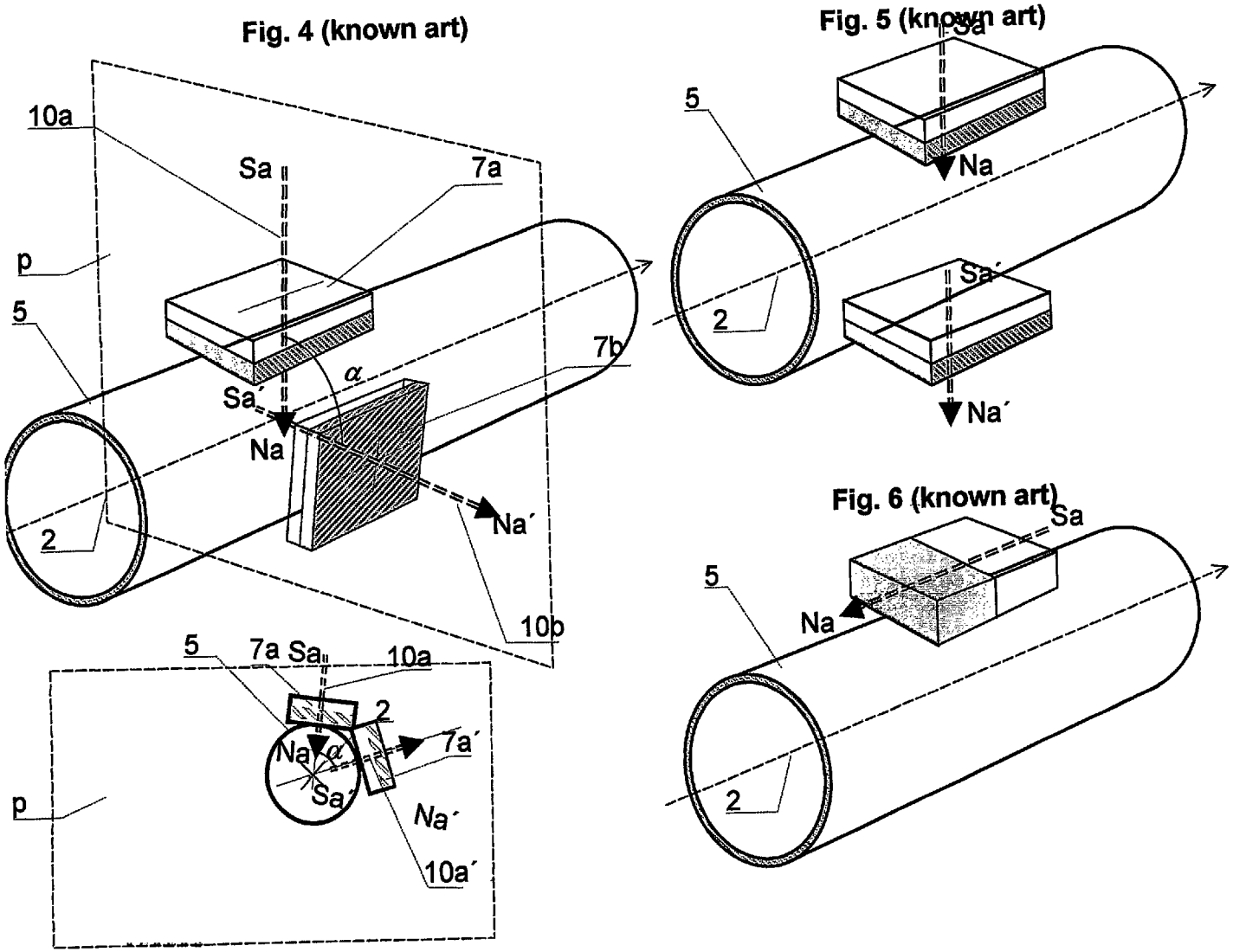
Fig. 5 (known art)
Sa
Na
Sa´
Na´
5
2
Fig. 6 (known art)
Sa
Na
5
2
Fig. 4 (known art)
7a
7b
10a
10b
Sa
Sa´
Na
Na´
α
p
5
2
7a
7a´
10a
10a´
Sa
Sa´
Na
Na´
α
p
5
2

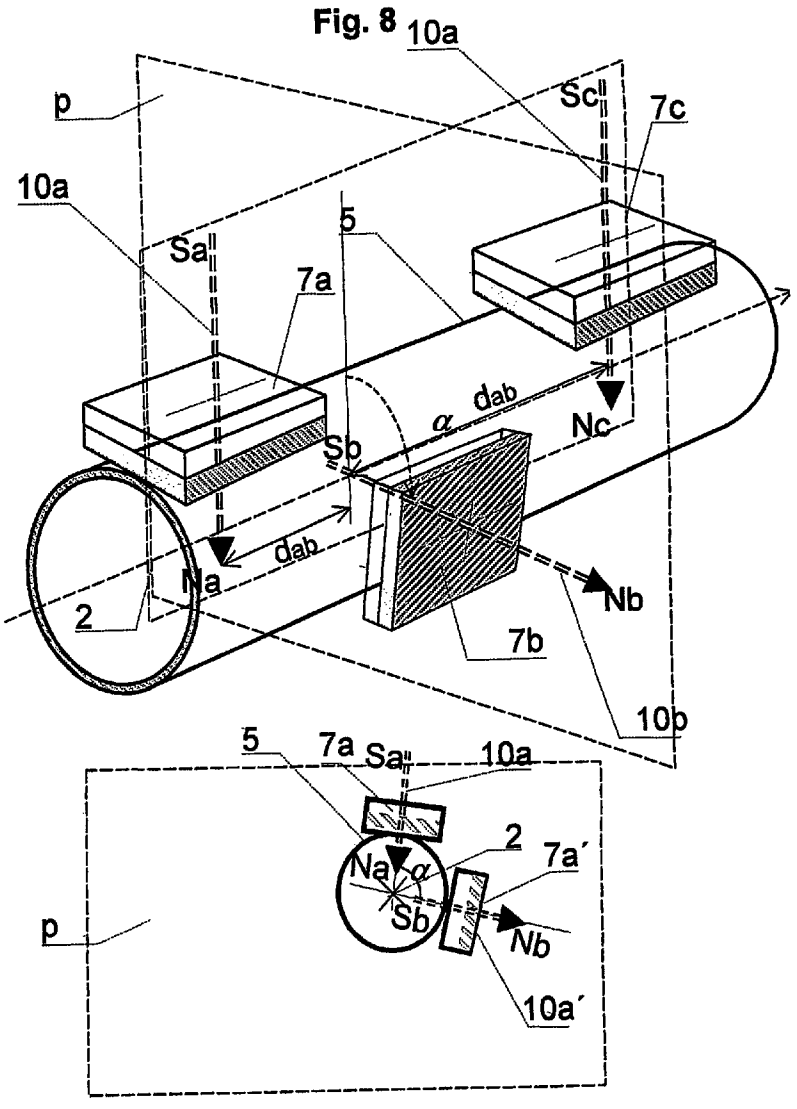
Fig. 8
10a
7c
Sc
Nc
Nb
10b
7b
dab
α
5
Sb
7a
Sa
Na
2
p
10a
7a
Sa
5
Na
α
Sb
2
7a´
Nb
10a´
p
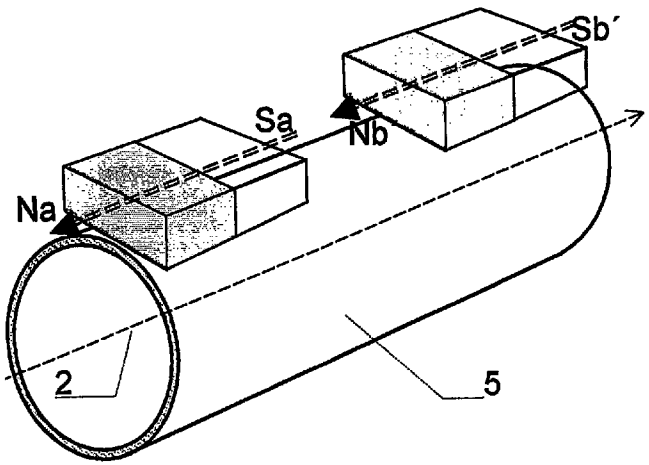
Fig. 7 (known art)
Sb´
Nb
Sa
Na
5
2

5
7b
10b
15
10a
7a
Sa
Na
Sb
11
12
2
11,12

Table 3

| | | | oct.02 | | | jan.03 | | | mar.03 | | | apr.03 | | | may 03 |
|---|---|---|---|---|---|---|---|---|---|---|---|---|---|---|---|
| Bus no. | Liter | km *10 | l/10km | Liter | km *10 | l/10km | Liter | km *10 | l/10km | Liter | km *10 | l/10km | Liter | km *10 | l/10km |
| A501 | 3005 | 817 | 3,68 | 1740 | 443 | 3,93 | 2965 | 851 | 3,49 | 2722 | 754 | 3,61 | 3366 | 878 | 3,83 |
| A502 | 3591 | 944 | 3,80 | 1910 | 523 | 3,65 | 3406 | 871 | 3,91 | 2565 | 765 | 3,35 | 3216 | 791 | 4,07 |
| A503 | 3431 | 846 | 4,06 | 2279 | 510 | 4,47 | 2849 | 664 | 4,29 | 3022 | 825 | 3,66 | 2905 | 842 | 3,45 |
| A504 | 2891 | 809 | 3,57 | 1245 | 468 | 2,66 | 2955 | 831 | 3,56 | 3025 | 894 | 3,38 | 3280 | 813 | 4,03 |
| A505 | 3289 | 937 | 3,51 | 1580 | 478 | 3,31 | 2949 | 826 | 3,57 | 2335 | 743 | 3,14 | 3490 | 906 | 3,85 |
| A506 | 2504 | 799 | 3,13 | 1774 | 484 | 3,66 | 2787 | 815 | 3,42 | 2430 | 695 | 3,50 | 1990 | 551 | 3,61 |
| A507 | 2503 | 688 | 3,64 | 2021 | 498 | 4,06 | 3142 | 814 | 3,86 | 2702 | 774 | 3,49 | 2764 | 670 | 4,13 |
| A508 | 3007 | 758 | 3,97 | 2441 | 570 | 4,29 | 3071 | 772 | 3,98 | 2387 | 734 | 3,25 | 3082 | 767 | 4,02 |
| A510 | 2338 | 726 | 3,22 | 2311 | 573 | 4,04 | 3392 | 908 | 3,74 | 2858 | 758 | 3,77 | 3231 | 826 | 3,91 |
| Sum with | 10236 | 3022 | 3,39 | 7351 | 2023 | 3,63 | 7351 | 2023 | 3,63 | 12276 | 3368 | 3,65 | 11015 | 3121 | 3,53 |
| Sum with | 16323 | 4301 | 3,80 | 9950 | 2524 | 3,94 | 9950 | 2524 | 3,94 | 15240 | 3983 | 3,83 | 13031 | 3821 | 3,41 |

DEVICE FOR PRECONDITIONING OF COMBUSTION AIR

INTRODUCTION

This invention relates to a set of magnets arranged at an intake line to a combustion device, more specifically magnets arranged at an air intake channel to a combustion engine or a fuel combustion device. The purpose of an embodiment of the invention is either to reduce a fuel consumption of the device while a power output of the device is maintained at the same level, or to increase the power output while the fuel consumption is maintained, or a combination of a balanced reduction in fuel consumption and an increased power output according to the user's needs.

KNOWN ART IN THE FIELD

Magnets in connection with fuel inlets to engines are known from several patents. U.S. Pat. No. 4,414,951 shows a set of magnets arranged around a fuel intake line to a carburetor. U.S. Pat. No. 4,755,288 shows a magnetic field generator for magnetically treating fluid flowing through a conduit. U.S. Pat. No. 5,500,121 is a magnetic fluid treatment device. U.S. Pat. No. 6,041,763 is a device for preconditioning fuel before it enters an internal combustion chamber or a furnace. GB 2 122 253 describes a pair of permanent horseshoe magnets arranged on a fuel pipe and spaced apart. U.S. Pat. No. 5,331,807 describes a magnet arranged on the air intake pipe and another magnet arranged on a fuel line to a motor. GB 2 293 782 describes two magnets arranged on a fuel intake line. U.S. Pat. No. 5,615,658 describes a set of magnets arranged on an air inlet.

PROBLEM TO BE SOLVED BY THIS INVENTION

This invention comprises a new arrangement of magnets for being arranged generally perpendicularly to the air path into a combustion chamber, for reducing the fuel consumption and for possibly reducing the particle emission arising from incomplete combustion. Alternatively, the magnets arranged according to the invention may increase the power of a combustion of a constant feed of fuel as compared to a combustion running without magnets arranged.

SHORT SUMMARY OF THE INVENTION

The invention is a device for pre-conditioning of combustion air at an inlet path to a combustion chamber, in which said inlet comprises a set of two or more magnetic fields arranged along said inlet path,

- each of said magnetic field having a corresponding north pole and a corresponding south pole and a general magnetic moment vector extending from said south pole portion to said north pole; of which the novel features of the invention comprises the following features:
- said magnetic moment vectors being arranged mainly perpendicularly with respect to said inlet path;
- said magnetic moment vectors being distributed consecutively along said inlet path;
- said second or consecutive magnetic field being arranged having said second or consecutive magnetic moment vector's pole with the opposite pole adjacent to said inlet path with respect to said first or preceding magnetic moment vector's pole.

The invention may alternatively be summarized as a device for pre-conditioning of combustion air at an inlet path to a combustion chamber, in which said inlet comprises a set of two or more magnetic fields arranged along said inlet path;

- each said magnetic field having a general magnetic moment vector extending from said south pole portion to said north pole; in which the novel features are comprised by the following features
- said magnetic moment vectors being arranged mainly perpendicularly with respect to said inlet path;
- said magnetic moment vectors being distributed consecutively along said inlet path;
- said first and second magnetic moments forming an angle ($\alpha$) between 180° degrees and 60° degrees as seen along said inlet path, i.e. in a plane perpendicular to said inlet path.

Another alternative definition of the invention is a device for pre-conditioning of combustion air at an inlet path to a combustion chamber, in which said inlet comprises a set of two or more magnetic fields arranged along said inlet path,

- each of said magnetic field having a corresponding north pole and a corresponding south pole and a general magnetic moment vector extending from said south pole portion to said north pole; characterized in that
- said magnetic moment vectors being arranged mainly perpendicularly with respect to said inlet, said inlet path leading through an aperture at an inlet end of an air pipe;
- said magnetic moment vectors being distributed consecutively along said inlet path;
- said second or consecutive magnetic field being arranged having said second or consecutive magnetic moment vector's pole with the opposite pole adjacent to said inlet path with respect to said first or preceding magnetic moment vector's pole.

FIGURE CAPTIONS

The invention is illustrated in different embodiments in the attached drawings. The drawings are made for illustrating the invention and shall not be construed so as to be limitations of the invention. The invention is defined in the attached claims.

FIG. 1*a* illustrates a general principle of the invention, in which air flowing along a desired or given path into a combustion chamber must pass two or more magnetic fields having each their magnetic moment arranged perpendicularly to said path. The insert in the lower half of the sheet illustrates a plane that is transverse to the air path, seeing along the air path, showing the opposite arrangement of one magnetic moment and a consecutive magnetic moment along the path.

FIG. 1*b* illustrates a preferred embodiment of the invention, in which three magnetic moments are arranged consecutively and perpendicularly to an inlet pipe for air, said air inlet pipe eventually feeding air into a combustion chamber in a combustion engine. We have discovered that this arrangement results in a reduced fuel consumption for equal energies produced, or higher power output for equal fuel mass consumed.

FIG. 1*c* is a cross-section of the air supply line (5) as seen along said air path (2) at a position of the first magnet (7*a*) arranged on an outer surface of an air supply line (5).

FIG. 1*d* is a cross-section of the air supply line (5) as seen along said air path (2) at a position of the first magnet (7*a*) arranged on an inner surface of said air supply line (5).

FIG. 1*e* is a cross-section of the air supply line (5) as seen along said air path (2) at a position of the first magnet (7*a*) arranged inside the pipe wall of the air supply line (5).

FIG. 1*f* is a cross-section of the air supply line (5) as seen along said air path (2) at a position of the first magnet (7*a*)

arranged on an outer surface of a flattened section (5*s*) of the air supply line (5), said flattened section (5*s*) preferably having the same cross-section area as preceding and subsequent sections of said air supply line (5).

FIG. 1*g* shows an embodiment according to the invention having the magnets (7*a*, 7*b*, 7*c*), here three in number, arranged along an air inlet pipe (5).

FIG. 4 illustrates known art using magnets arranged in 45 degrees angular separation on a fuel supply line, and arranged with no axial separation.

FIG. 5 shows an example of the known art using two magnets arranged with their magnetic moments parallel to a fuel supply line's axis, said magnets arranged on either side of said fuel supply line.

FIG. 6 also shows examples of the known art, using one single magnet arranged with the magnetic moment along, athwart or perpendicular to said fuel supply line.

FIG. 7 illustrates a known variant of FIG. 6, of which said magnetic moments are arranged in line and on one side of a fuel supply line.

Figure 1A:
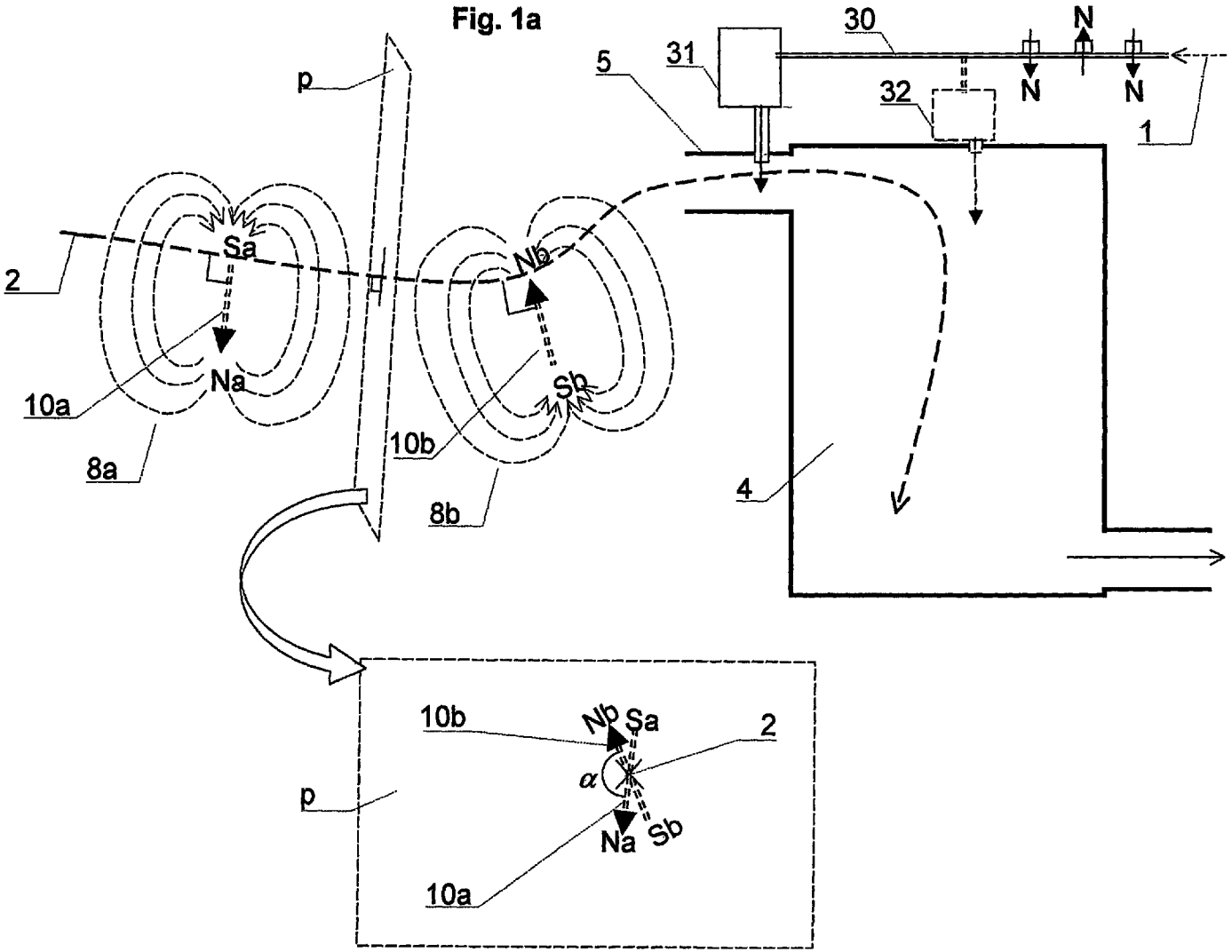
Figure 1B:
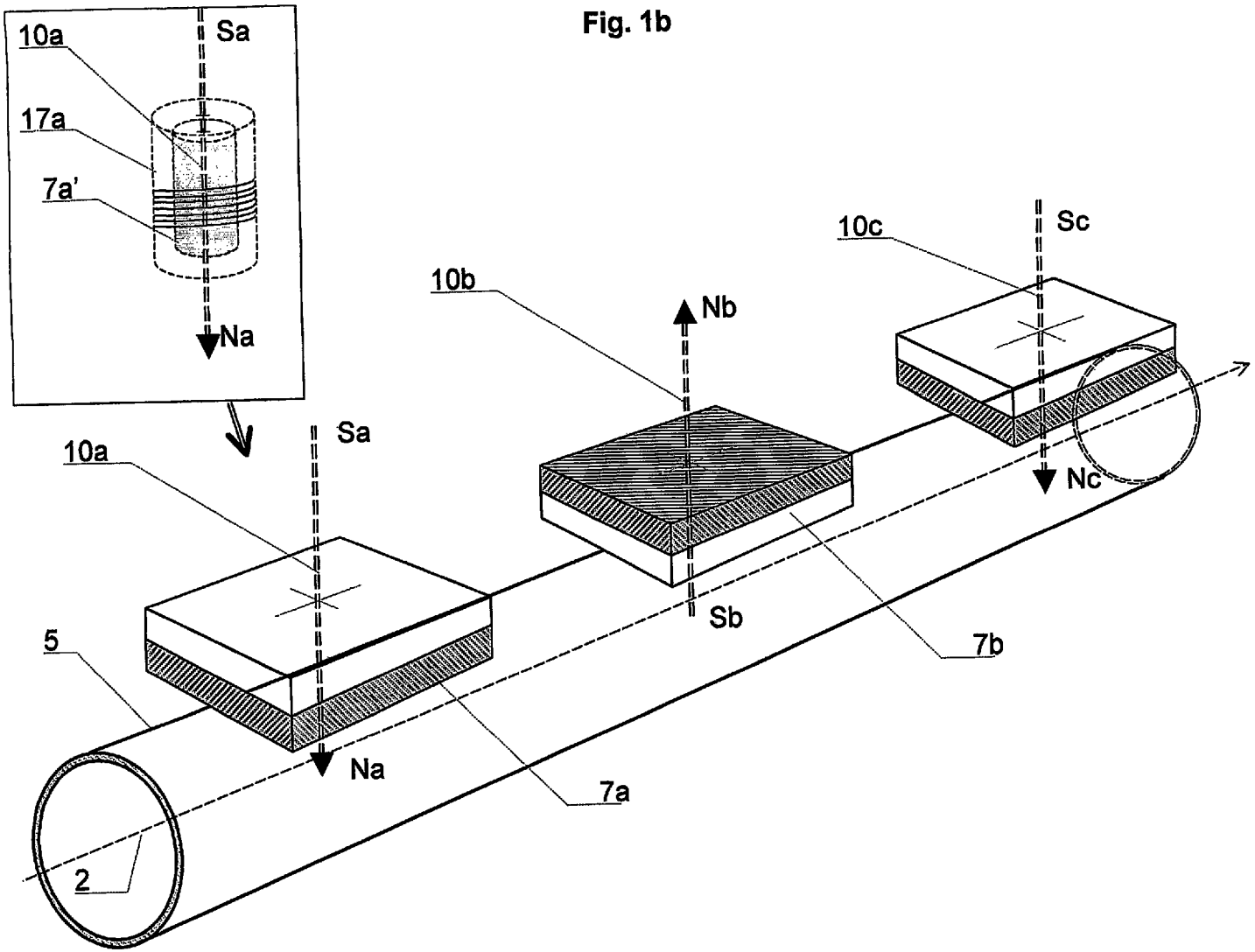
Figure 2:
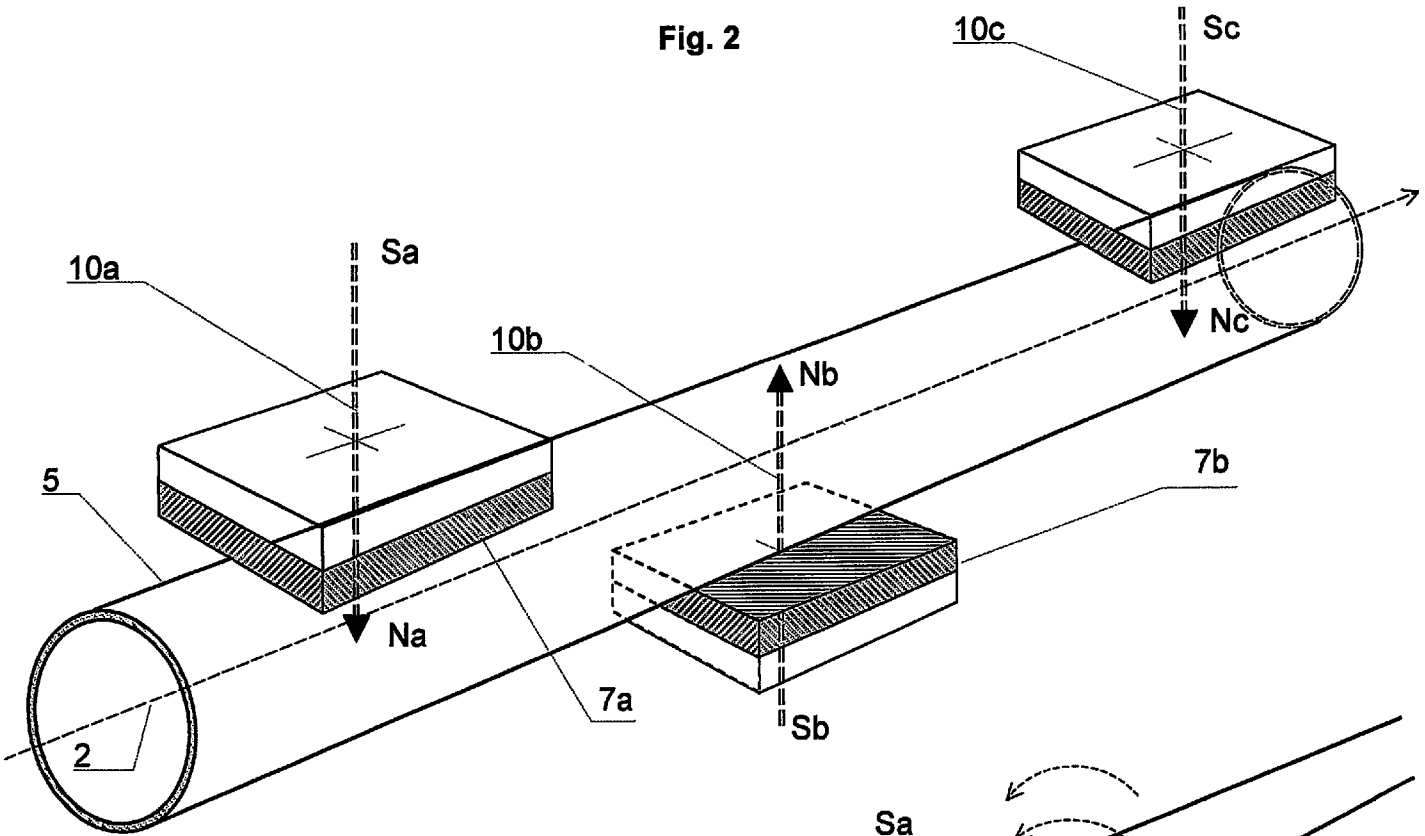
FIG. 2 illustrates an alternative embodiment of the invention similar to the arrangement in FIG. 1*b*, but of which the second magnetic moment is arranged on an opposite side of said inlet pipe. This configuration has not proved equally fuel efficient as compared to the arrangement shown in FIG. 1*b*.

FIG. 8 illustrates an alternative preferred embodiment of the invention in which the arrangement of the second magnet is a cross-breed of the embodiments of FIG. 1*b* and FIG. 2. The second magnet "B" is arranged at an angle about the axis of the air supply line with respect to the first magnet "A". The third magnet "C" is here shown in the same angular position as magnet "A".

Figures 9A, 9B, 9C:
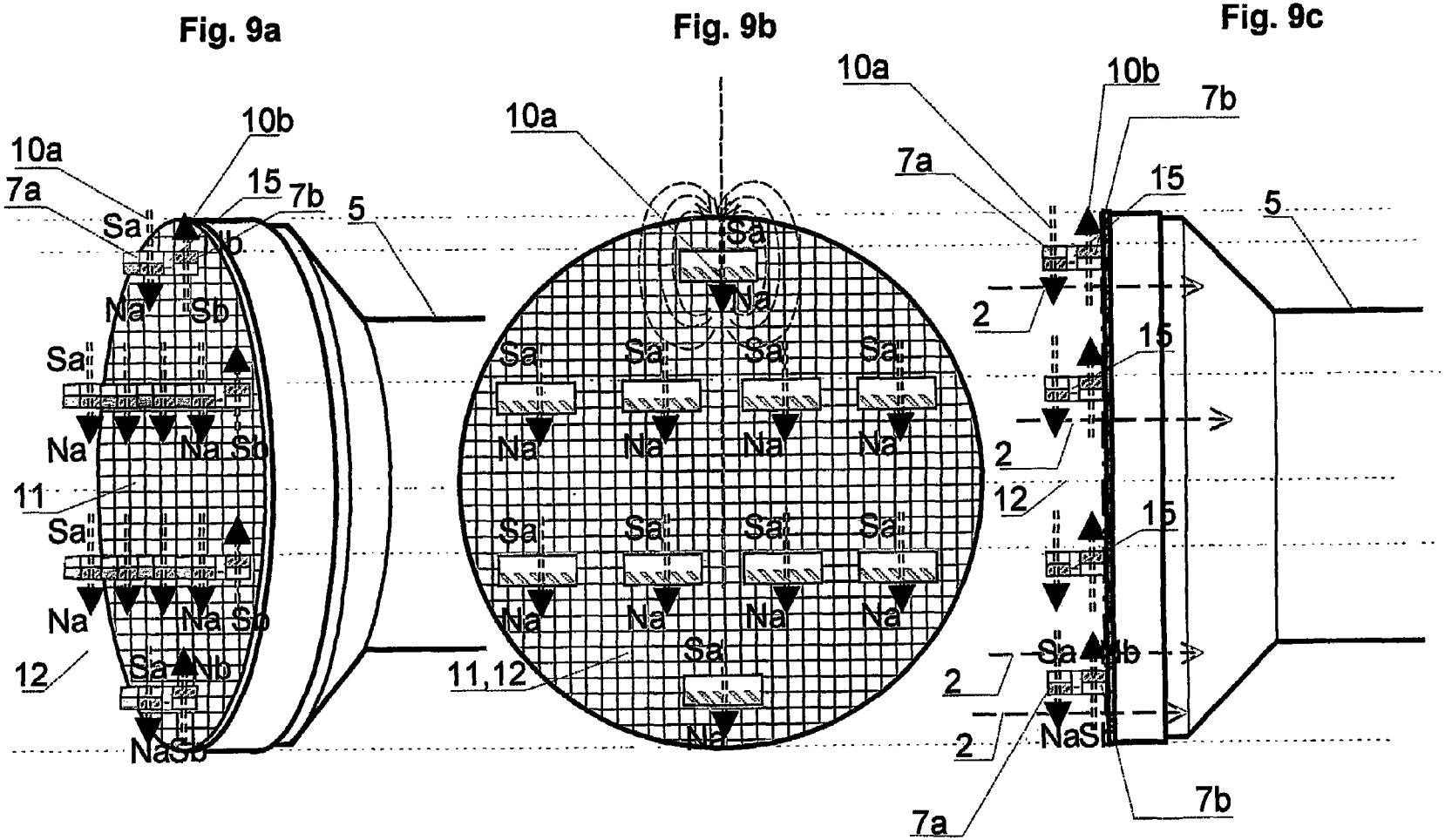

FIG. 9*a* relates to a larger combustion engine. For a larger fuel combustion device, e.g. a power plant with a steam turbine driven electric generator, a marine engine, or a marine turbine, all requiring a large feed of air, the diameter of an inlet pipe may be on the order of 5 to 50 centimeters, or the pipe wall thickness may be several mm, possibly in magnetically permeable steel, thus reducing the effectively sensed magnetic field acting on the passing air, so other embodiments of magnets may be arranged at the end of the pipe as shown in FIGS. 9 and 10. FIG. 9*a* is a perspective view an alternative preferred embodiment of the invention, showing an axial air inlet (12) for a large engine or a large combustion engine or a combustion device for e.g. a bitumen heater for heating asphalt before mixing with rock mass and filler during production of asphalt e.g for road paving. The preferably circular inlet (12) is shown covered by an inlet grille (11) for preventing undesired passage of dust, leaves, cloths, or any object other than air. Such combustion devices may also comprise a marine engine or turbine, a marine generator, or a steam boiler for a power plant turbine, or similar.

FIG. 9*b* is an end view of the air inlet grille of FIG. 9*a*, with a set of magnets arranged on the grille's (11) mesh covering the air inlet. In a preferred embodiment, the moments of the magnets is arranged parallel with the plane of the grille (11) so as to be perpendicular to the air path through the grille (11).

FIG. 9*c* is a side view of the same inlet grille of FIG. 9*a*. The magnetic moments are here shown in equally directed pairs of mutually oppositely arranged magnetic moments, e.g. all magnetic moments of the magnets arranged adjacent to the grille (11) directed in one common direction, and with all magnetic moments of the magnets arranged in- the second "layer" of magnets on top of the first, directed in an opposite direction with respect to the first layer's moments. In this way, the air flow will pass through at least two oppositely directed main magnetic fields on its path through the grille (11) on entering the air inlet (12) to the air inlet pipe (5).

Figure 9D:
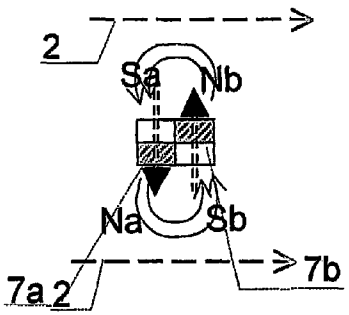

FIG. 9*d* illustrates an undesired effect of magnetic field lines of magnet (7*a*) returning directly through an adjacent and oppositely directed magnet (7*b*).

Figure 9E:
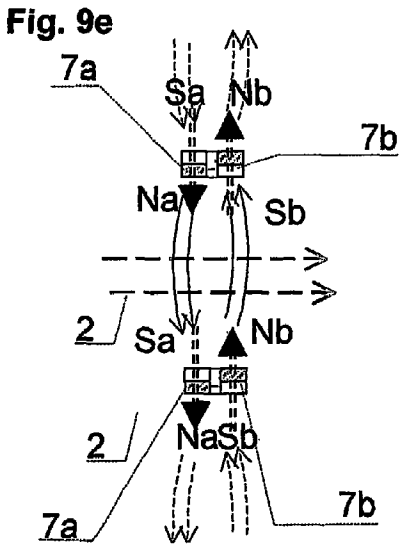

FIG. 9*e* illustrates a desired effect of magnetic field lines of one magnet (7*a*) continuing through a neighbour and equally directed magnet (7*a*).

Figure 10C:
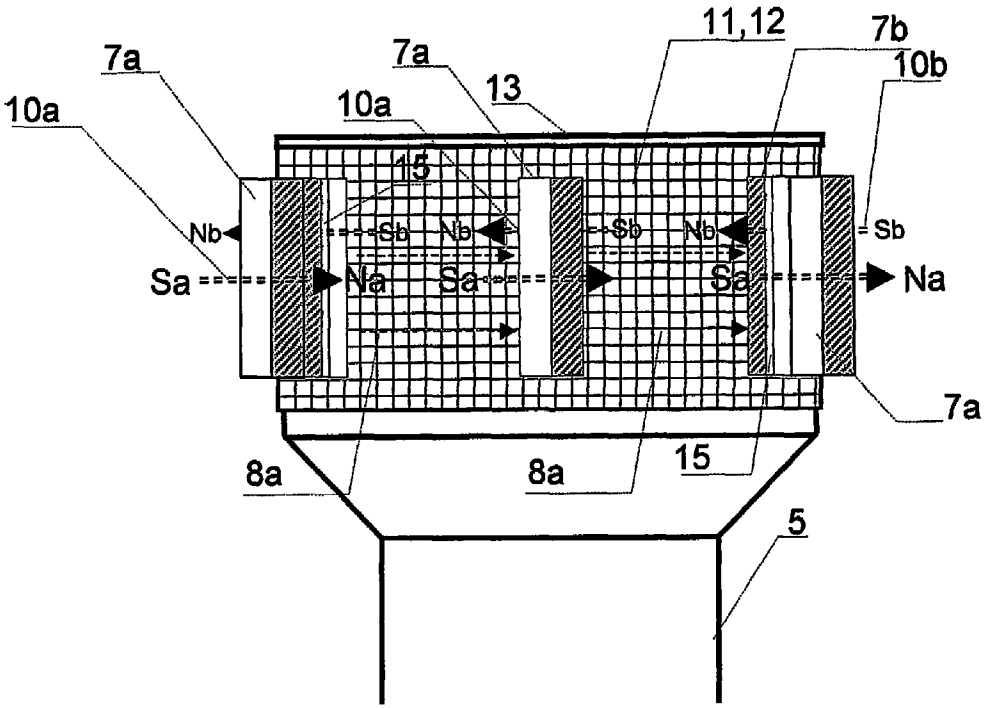
Figure 10B:
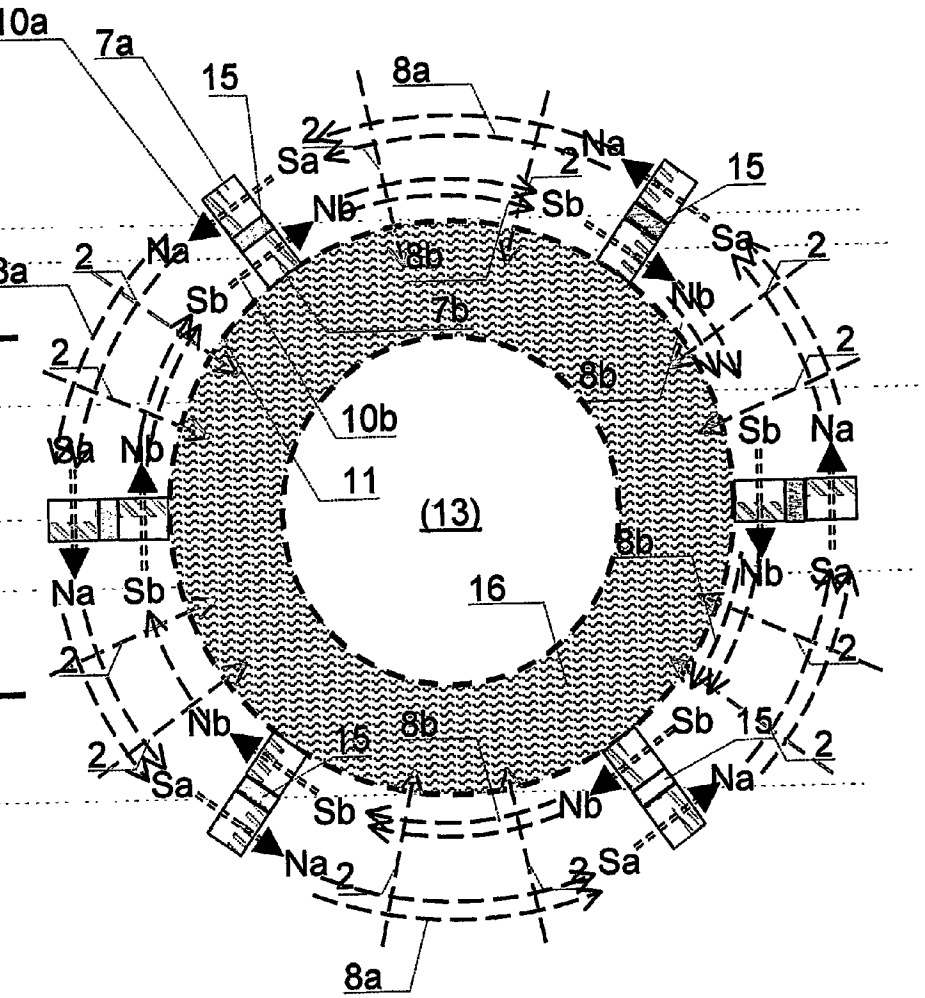
Figure 10A:
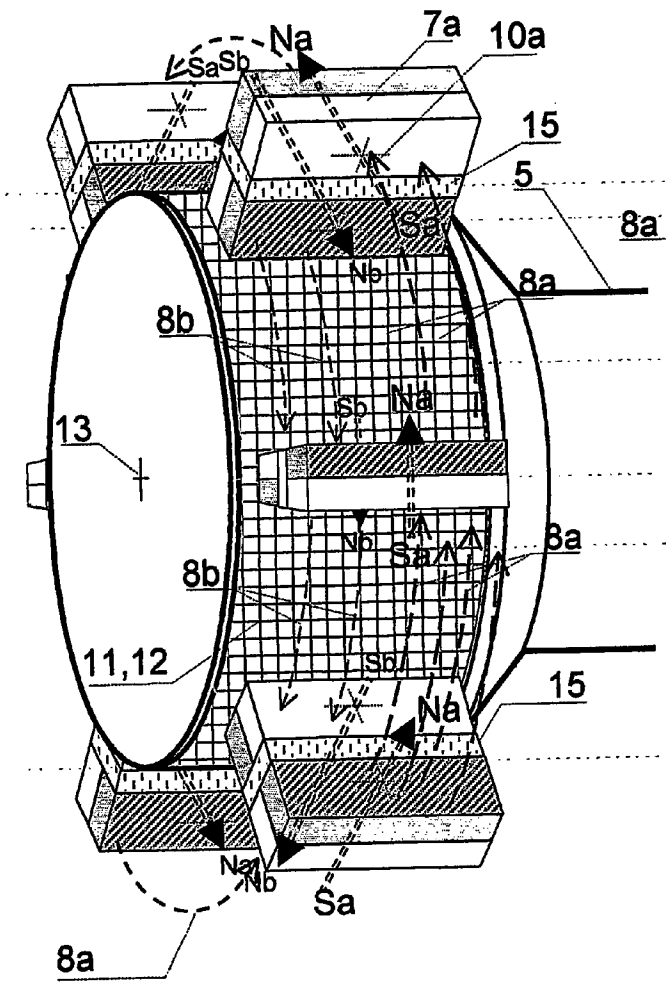

FIG. 10*a* is a perspective view of another alternative preferred embodiment of the invention, showing an radial air inlet device for similar usage as for the air inlet illustrated in FIG. 9 and described above.

FIG. 10*b* is an end view of the same, here showing one first set of magnets arranged on the peripherally arranged cylindrical sleeve-shaped grille (11) covering an aperture (12) between a pipe's (5) end piece and an oppositely arranged end plate (13), and having their magnetic moments pointing in a common counterclockwise direction, and a second set of magnets arranged outside of the firs set and having their magnetic moments directed in a clockwise direction.

FIG. 10*c* is a side view corresponding to the side view of FIG. 10*b*, showing the two sets of magnets arranged on the radial inlet (12) through the cylindrical sleeve-shaped grille (11) around the periphery of an end plate (13) of an air inlet pipe (5). The end of the pipe is covered by the above mentioned end plate (13).

Figure 11:
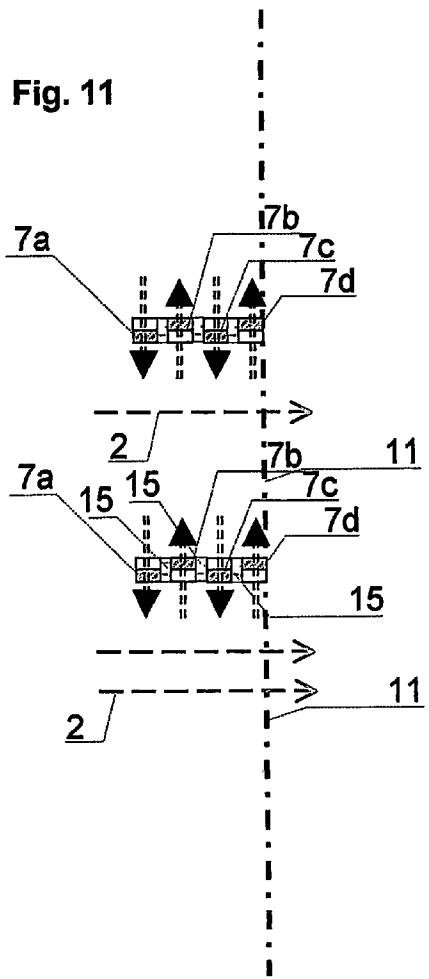

FIG. 11 illustrates the use of separator pieces (15) between magnets of opposite polarity directions, possibly between a lowermost magnet and a substrate onto which it is attached.

Figure 12:
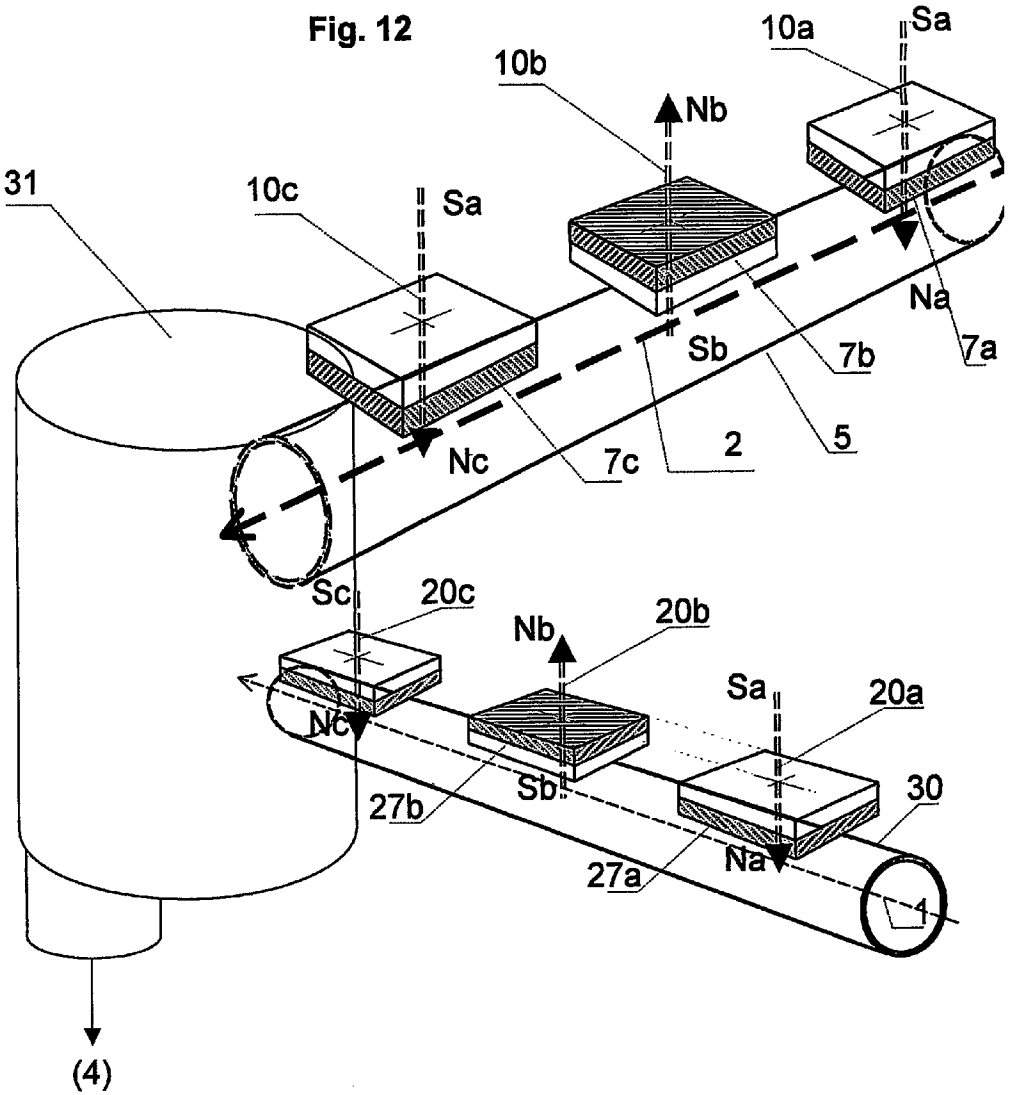

FIG. 12 shows a combination of a fuel supply line (30) for fuel (1) provided with magnets (27*a*, 27*b*, 27*c*) arranged with opposite polarities adjacent to the fuel supply line, in addition to the first variant of a combustion air line (5), both running into a carburetor (31) for feeding a combustion chamber (4), or both supply lines (30) and (5) running directly into said combustion chamber (4).

Figure 13:
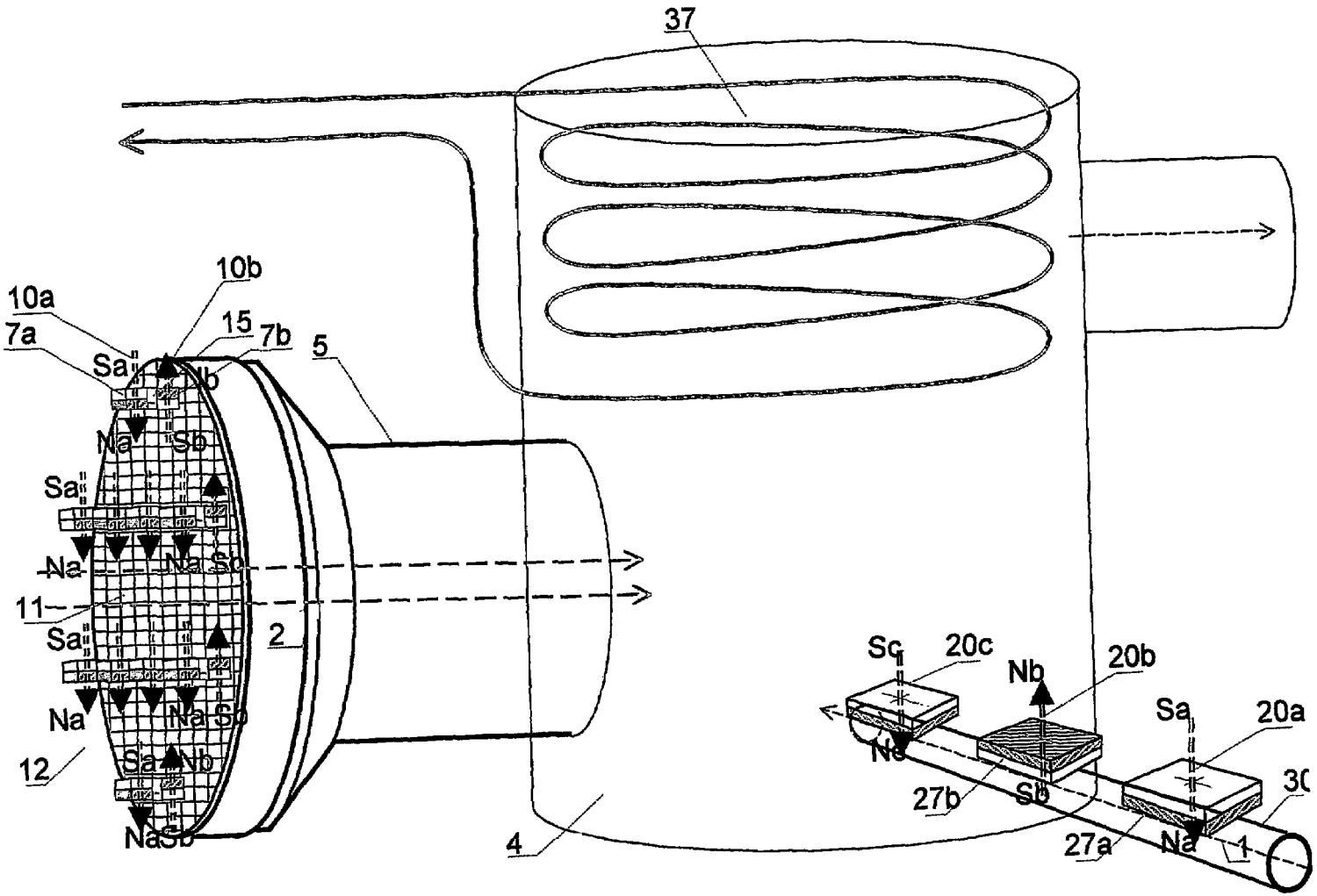

FIG. 13 shows a combination of a fuel supply line (30) for fuel (1) provided with magnets (27*a*, 27*b*, 27*c*) arranged with opposite polarities adjacent to the fuel supply line, in addition to the variant of magnets arranged on a grille (11) on an air intake end opening (12) a combustion air intake pipe (5), both running into a combustion chamber (4) on a burner unit for heating some fluid running in a coil for being heated.

Figure 14:
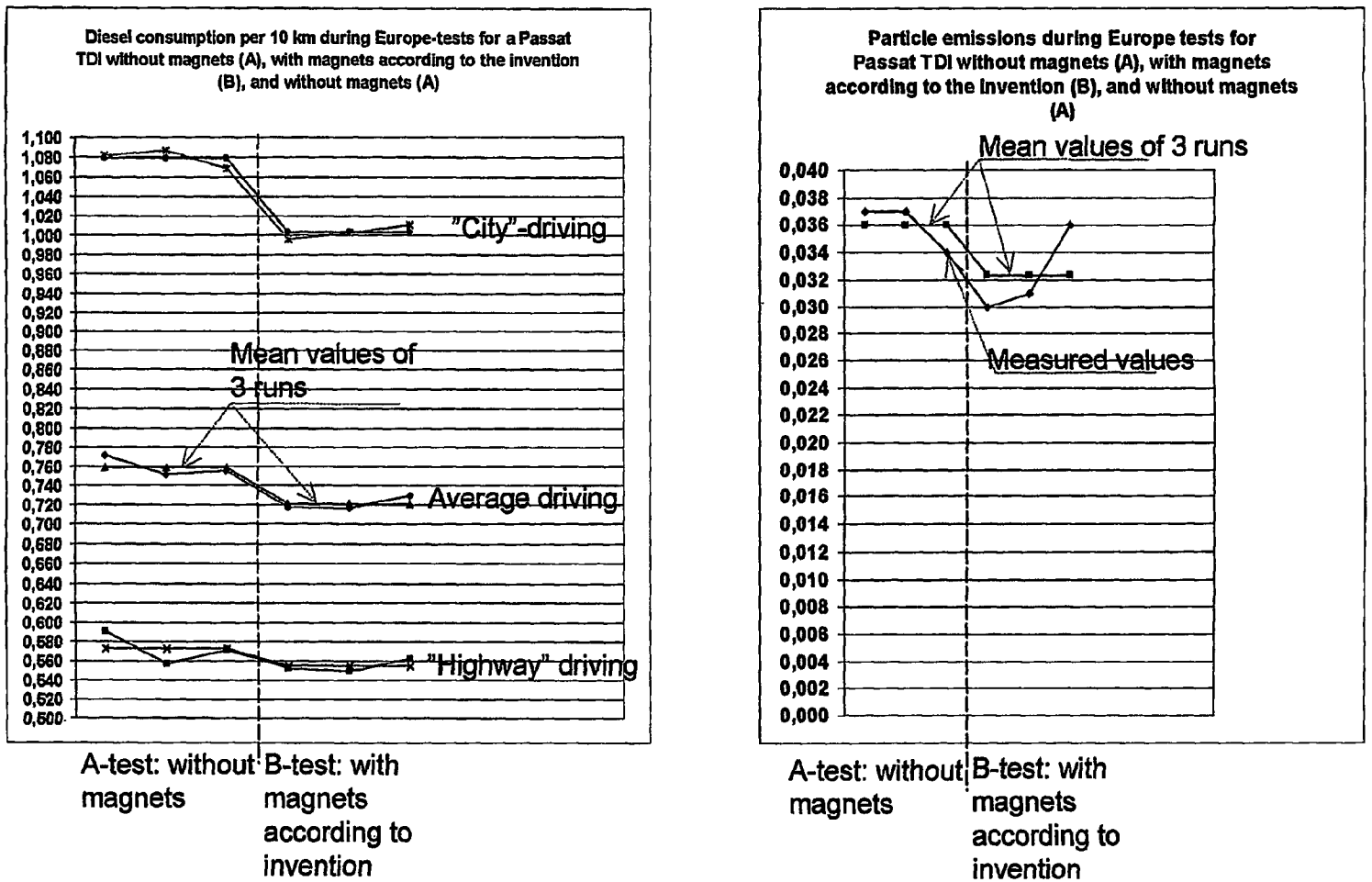

FIG. 14 comprises two diagrams showing fuel consumption and particle emissions during a series of laboratory experiments.

Figure 15:
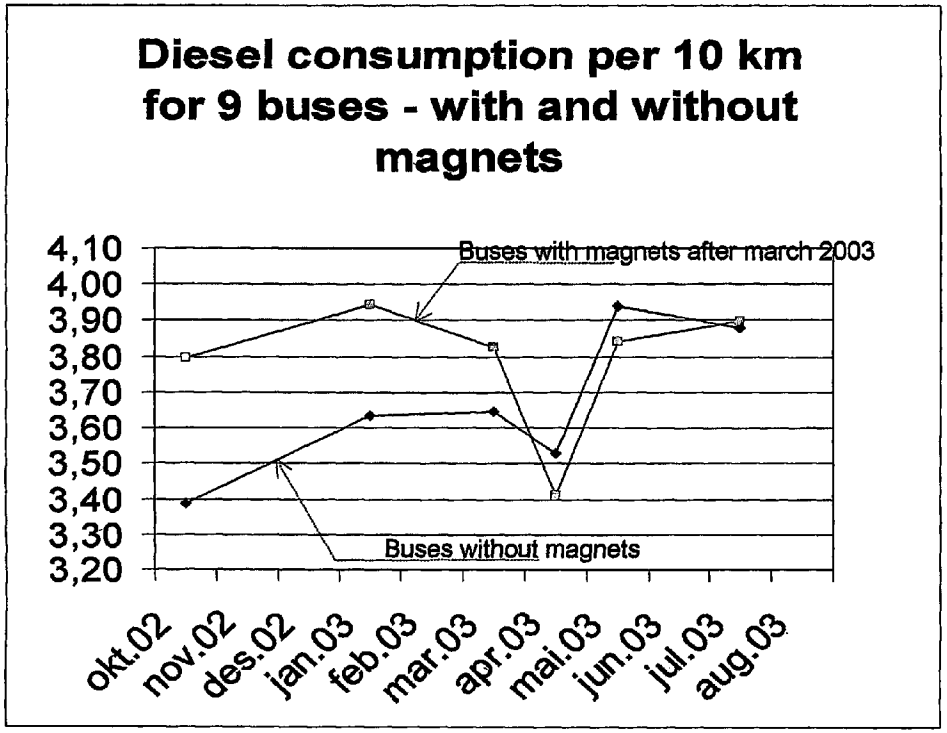

FIG. 15 shows a diagram of graphs of average fuel consumptions of two sets of buses used in ordinary traffic.

DESCRIPTION OF PREFERRED EMBODIMENTS OF THE INVENTION

A general principle of the invention is illustrated in the attached FIG 1*a*. Combustion air flows along a path (2) into a combustion chamber (4). The combustion air (2) must, according to the invention, pass two or more consecutively arranged magnetic fields (8*a*, 8*b*) having each their magnetic moment (10*a*, 10*b*), both magnetic fields (8*a*, 8*b*) arranged perpendicularly to said path (2). It is assumed that fuel (1) is provided by means of a fuel line (30). The fuel (1) may enter the combustion chamber (4) by injection into the air flow (2) before entering the combustion chamber (4) by means of a carburetor (31) or, alternatively, directly into the combustion chamber (4) by means of a fuel injection pump (32). In FIG.

1*a* a plane (p) being perpendicular to the air path (2) is indicated. In the lower part of the sheet this plane is seen along the path (2). It is indicated that the magnetic moment vectors (10*a*, 10*b*) form an angle α. This angle may maximally be 180°, that is, the second or consecutive magnetic moment (10*b*, 10*c*, . . . ) is directed oppositely with respect to the first or preceding magnetic moment (10*a*, 10*b*, . . . ). However, in other embodiments of the invention, the angle between a consecutive and the preceding magnetic moments may be less than 180°, and may be as little as about 60°. Such an alternative embodiment is illustrated in FIG. 8, in which the angle α is about 90°. Please notice that the embodiment illustrated in FIG. 8 with consecutive magnets along the path (2), is entirely different from the situation of known art illustrated in FIG. 4, in which two magnetic moments are arranged with a mutual angle at the same axial position along the path (2). The combustion air may in an alternative embodiment be more or less pure oxygen, i.e. without part or all of the normal nitrogen content of ordinary atmospheric air.

In FIG. 1*b*, is illustrated an air path (2) running through an air inlet pipe (5) and passing the two magnetic fields (8*a*) and (8*b*) arising from the magnetic moments (10*a*) and (10*b*) arranged consecutively along the air path (2). In FIG. 1*b* we do not discriminate between possible origins of the magnetic fields (8*a*, 8*b*) or magnetic moments (10*a*, 10*b*), which may be either permanent magnets (7*a*, 7*b*) of iron or similar permanently magnetized material, comprising each their magnetic moment (10*a*, 10*b*) permanently, as illustrated on the main figure of FIG. 1*b*, or non-permanently magnetized permeable cores (7*a*′, 7*b*′) magnetized by electric coils (17*a*, 17*b*) as illustrated in the insert figure at the upper left corner, or electric coils (17*a*, 17*b*) without permeable cores. In case of using coreless electric coils (17*a*, 17*b*, . . . ), the air path (2) may pass perpendicularly through the center of each coil (17*a*, 17*b*, . . . ).

FIG. 1*b* illustrates a preferred embodiment of the invention, in which three magnetic moments are arranged consecutively and perpendicularly to an inlet pipe for air, said air inlet pipe eventually feeding air into a combustion chamber in a combustion engine. We have discovered that this arrangement results in a reduced fuel consumption for equal energies produced, or higher power output for equal fuel mass consumed. However, for a larger fuel combustion device, e.g. a power plant with a steam turbine driven electric generator, a marine engine, or a marine turbine, the embodiment of FIG. 1*b* is not the best mode of the invention at the time of filing this application, but rather the embodiments illustrated in FIGS. 9*a*, *b*, and *c* and in FIGS. 10*a*, *b* and *c*, which illustrate embodiments for arranging magnetic fields at the air inlet to a larger fuel combustion device, e.g. a power plant with a steam turbine driven electric generator, a marine engine, or a marine turbine, said arrangement being described later in this specification.

Figure 1D:
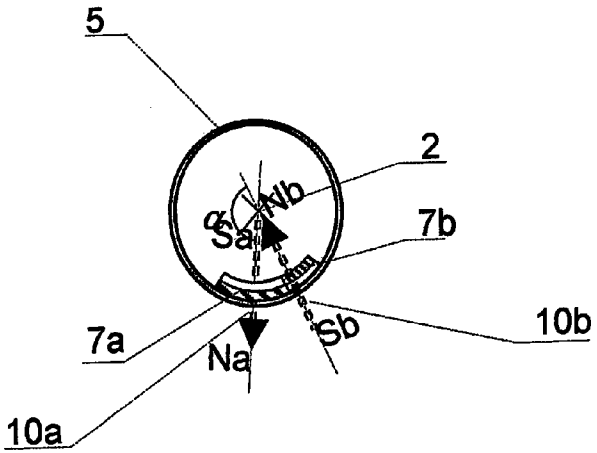
Figure 1F:
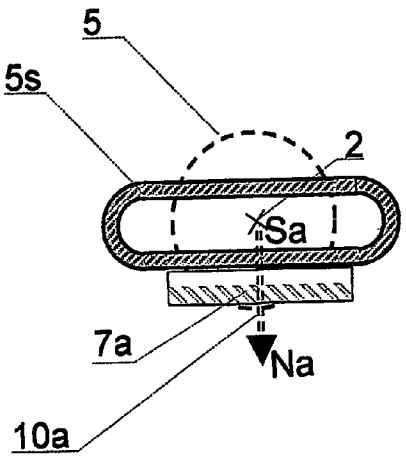
Figure 1C:
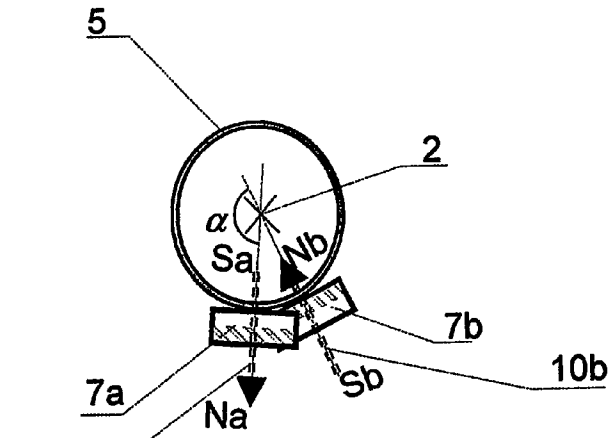

FIG. 1*c* is a cross-section of the air supply line (5) as seen along said air path (2) at a position of the first magnet (7*a*) arranged on outer surface the air supply line (5). In this view, magnet (7*b*) is the subsequent magnet for the air to pass. Magnetic moment (10*b*) is illustrated with an angle α of about 150°.

If the air supply line (5) is of large diameter or particularly permeable magnetic material, the magnetic field (8*a*, 8*b*, 8*c*, . . . ) of magnets (7*a*, 7*b*, 7*c*, . . . ) may be considerably reduced in field force and also significantly deviated in direction, so it may be advantageous to arranged the magnets (7*a*, 7*b*, 7*c*, . . . ) at the inner wall of said air supply line (5), as illustrated in FIG. 1*d*. In order to prevent an undesired restriction of the air passage, the magnets may be provided with curved surfaces.

Figure 1E:
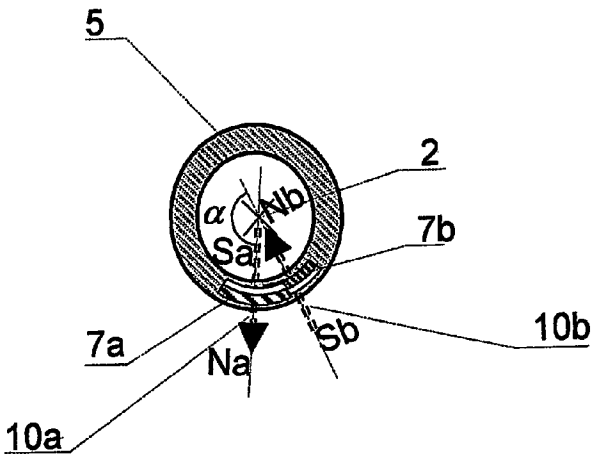

FIG. 1*e* is a cross-section of the air supply line (5) as seen along said air path (2) at a position of the first magnet (7*a*) arranged inside the pipe wall of the air supply line (5). This embodiment is possible in arrangements using moulded-in magnets in a synthetic, non-magnetic material like plastic of polyethylene which may be used in the production of air supply pipes. Like above, it may be advantageous to provide curved surface magnets both in order for providing a rounded inner wall of the pipe and to provide a slender pipe. Please notice that for the embodiments shown in FIGS. 1*c*, 1*d*, and 1*e*, the successive magnet is illustrated as out-of-line or out-of-angle with an angle of 30° (i.e. α being 150°), but in a preferred embodiment, α is about 180°, i.e. magnet (7*b*) would be hidden behind magnet (7*a*).

FIG. 1*f* is a cross-section of the air supply line (5) as seen along said air path (2) at a position of the first magnet (7*a*) arranged on an outer surface of a flattened section (5*s*) of the air supply line (5), said flattened section (5*s*) preferably having the same cross-section area as preceding and subsequent "ordinary" shaped sections of said air supply line (5). This flattened section (5*s*) of air supply line (5) provides closer passage to a magnetic pole (Sa or Na, Nb or Sb, . . . ) for a larger proportion of the air passing through the air supply line (5, 5*s*). As the magnetic field is stronger adjacent to a magnetic pole (Sa, Na, Nb or Sb, . . . ) of a magnet (7*a*, 7*b* . . . ), more air will be subject to a stronger field using a flattened section (5*s*) of the air supply line than for using a round pipe for the air supply line (5), given a flat surface of the magnet (7*a*, 7*b*, . . . ).

Figure 1G:
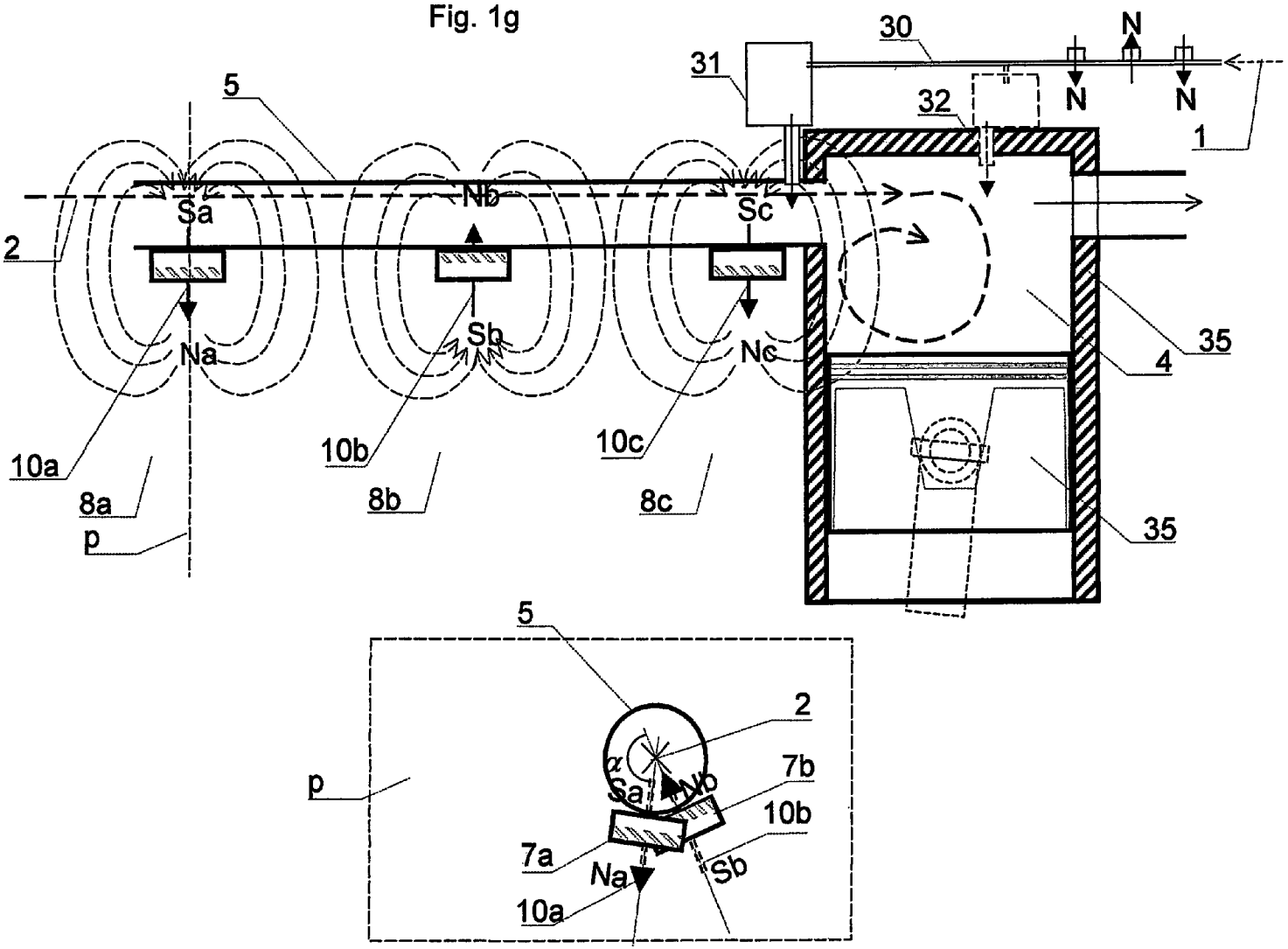

One embodiment according to the invention is provided having the magnets (7*a*, 7*b*, 7*c*), here three in number, arranged along an air inlet pipe (5) as illustrated in FIG. 1*g*. In one alternative of this embodiment, the air may be magnetically conditioned in the air supply line (5) before entering a carburetor (31) for being mixed with fuel supplied from a fuel line (30) feeding e.g. gasoline or diesel oil. In a second alternative, air may be fed into the combustion chamber (4) and fuel (1) may be fed separately into said combustion chamber (4) through a nozzle from said fuel line (30) via a fuel injection pump (32) as shown with broken lines in FIG. 1*g*. Also illustrated are magnets arranged in a transverse manner on the fuel supply line (30) for both alternative embodiments. Please notice that the combustion chamber (4) indicated may be one of several types combustion chambers, e.g. of a car or boat motor with a cylinder (35) and a piston (36), said motor running on gasoline, diesel or gas, etc., the motor otherwise made according to the known art, but may alternatively be a combustion chamber (4) for a turbine. The details of the combustion chamber (4) not being described in particular detail in this application, as the invention relates to the preconditioning of combustion air and fuel before they reach the combustion chamber. The insert view in FIG. 1*g* is similar to FIG. 1*c*.

FIG. 2 illustrates an alternative embodiment of the invention similar to the arrangement in FIG. 1*b*, but in which the second magnetic moment is arranged on an opposite side of said inlet pipe, still having the second magnetic moment (10*b*) directed in the opposite direction of the preceding and the subsequent magnetic moments (10*a*, 10*c*). This configuration has not proved equally efficient as compared to the arrangement shown in FIG. 1*b*.

Figure 3:
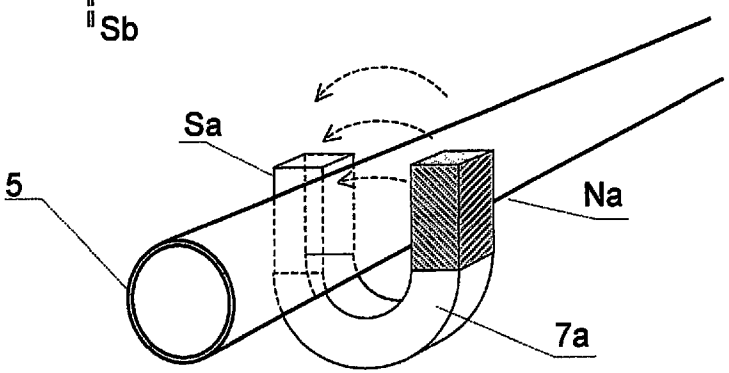
FIG. 3 illustrates a known patent application with one single horseshoe-shaped magnet arranged with a fuel supply line passing through the horseshoe-shape and perpendicular to a line passing through the magnetic poles.

FIG. 3 illustrates a known magnetic arrangement with one single horseshoe-shaped magnet arranged with a fuel supply line passing through the horseshoe-shape and perpendicular to a line passing through the magnetic poles.

FIG. 4 illustrates known art using magnets arranged in about 45 degrees angular separation on a fuel supply line, not an air inlet pipe, and arranged with no axial separation as opposed to the present invention.

FIG. 5 shows an example of the known art using two magnets arranged with their magnetic moments parallel to a fuel supply line's axis, said magnets arranged on either side of said fuel supply line.

FIG. 6 also shows examples of the known art, using one single magnet arranged with the magnetic moment along, athwart or perpendicular to said fuel supply line.

FIG. 7 illustrates a known variant of FIG. 6, of using two magnetic moments arranged in line and on one side of a fuel supply line.

FIG. 8 illustrates an alternative preferred embodiment of the invention in which the arrangement of the second magnet is a cross-breed of the embodiments of FIG. 1*b* and FIG. 2. The second magnet "B" is arranged at an angle about the axis of the air supply line with respect to the first magnet "A". The third magnet "C" is here shown in the same angular position as magnet "A".

FIGS. 9*a, b,* and *c* and FIGS. 10*a, b* and *c,* illustrate embodiments for arranging magnetic fields at the air inlet to a larger fuel combustion device, e.g. a power plant with a steam turbine driven electric generator, a marine engine, or a marine turbine, said arrangement being described later in this specification. FIG. 9*a* is a perspective view an alternative preferred embodiment of the invention, showing an air axial air inlet (12) for a large engine or a large combustion engine or a combustion device for e.g. a bitumen heater for heating asphalt before mixing with rock mass and filler during production of asphalt e.g for road paving. The preferably circular inlet (12) is shown covered by an inlet grille (11) for preventing undesired passage of dust, leaves, cloths, or any object other than air. Such combustion devices may also comprise a marine engine or turbine, a marine generator, or a steam boiler for a power plant turbine, or similar.

FIG. 9*b* is an end view of the air inlet grille of FIG. 9*a,* with a set of magnets arranged on the grille's (11) mesh covering the air inlet. In a preferred embodiment, the moments of the magnets is arranged parallel with the plane of the grille (11) so as to be perpendicular to the air path through the grille (11).

FIG. 9*c* is a side view of the same inlet grille of FIG. 9*a.* The magnetic moments are here shown in equally directed pairs of mutually oppositely arranged magnetic moments, e.g. all magnetic moments of the magnets arranged adjacent to the grille (11) directed in one common direction, and with all magnetic moments of the magnets arranged in the second "layer" of magnets on top of the first, directed in an opposite direction with respect to the first layer's moments. In this way, the air flow will pass through at least two oppositely directed main magnetic fields on its path through the grille (11) on entering the air inlet (12) to the air inlet pipe (5). A separator piece (15) is arranged between magnet (7*a*) and magnet (7*b*) so as to provide a more desired field distribution and a stronger magnetic field to act on the air flow (2) passing between magnets (7*a, 7a*) said air flow (2) further passing on between the oppositely directed magnets (7*b, 7b*). The separator piece (15) will counteract the undesired effect illustrated in FIG. 9*d,* in which is shown magnetic field lines of magnet (7*a*) from returning directly through the adjacent and oppositely directed magnet (7*b*). FIG. 9*e* illustrates a desired effect of magnetic field lines of one magnet (7*a*) continuing through a neighbour and equally directed magnet (7*a*). Each magnet (7*a*) is separated by the thickness of said separator piece (15), which is made of non-magnetic material, i.e. having very low magnetic susceptibility, from the nearest magnet (7*b*), thus leading to a continuation of the field lines of one magnetic field (8*a*) into the neighbour magnetic field (8*a*) of the neighbour magnet (7*a*) in the next pair. Thus, the air flow (2) will pass through a first magnet-to-magnet continuous magnetic field (8*a*) Which is perpendicular to the next, oppositely directed magnet-to-magnet magnetic field (8*b*) to be traversed by the air flow (2). The non-magnetic material of said separator piece may be a piece of aluminum, polyethylene, PET, wooden material, a piece of ceramic plate, or other suitable material which is able to withstand the attraction forces generated between the magnets (7*a, 7b*). More than one alternating magnet (7*a, 7b, 7c, . . .* ) may be stacked on the grille (11) on the air intake. A separator piece (15) of non-magnetic material may also be arranged between the grille (11) and the nearest magnet (7*b, 7c, . . .* ), see FIGS. 9 and 10 in which magnet (7*b*) is the one arranged nearest to the grille (11).

FIG. 10*a* is a perspective view of another alternative preferred embodiment of the invention, showing a radial air inlet device for similar usage as for the air inlet illustrated in FIG. 9 and described above.

FIG. 10*b* is an end view of the same, here showing one set of magnets arranged on the peripherally arranged cylindrical sleeve-shaped grille (11) covering an aperture (12) between a pipe's (5) end piece and an end plate (13), and having their magnetic moments pointing in a common clockwise peripheral direction, and another set of magnets arranged outside of the above mentioned set of magnets, and having their magnetic moments directed in an opposite, counterclockwise direction. Similar to FIG. 9*e,* this arrangement of an outer set of magnets (7*a*) arranged on non-magnetic separation pieces (15) on a next set of magnets (7*b*) arranged on the air intake grille (11). Because of the sleeve-shaped grille and the sets of magnets (8*a, 8b*) arranged with separation pieces (15) and arranged peripherally with their magnetizations (10*a, 10b*) also arranged in the peripheral direction, each magnet's (7*a*) magnetic field (8*a*) will have a tendency to continue into the neighbour magnets (7*a*) magnetic field (8*a*), and thus form a continuous magnetic field around the sleeve-shaped grille (11) of the air inlet (12). The same consideration is valid for the oppositely directed magnets' (7*b*) magnetic field (8*b*) arranged inside relative to the layer of the outer magnets (8*a*).

FIG. 10*c* is a side view corresponding to the side view of FIG. 10*b,* showing the two sets of magnets arranged on the radial air inlet (12) with the cylinder-shaped sleeve grille (11) around the periphery of an end plate (13) of an air intake pipe (5). The end of the pipe is covered by a plate (13). The embodiments illustrated in FIG. 9 and in FIG. 10 may be combined with the use of an air inlet filter (16) behind the grille (11) for stopping undesired particles or gas components or humidity.

FIG. 11 illustrates the use of separator pieces (15) between magnets (7*a, 7b, 7c, 7d*) of opposite polarity directions, and possibly with a separator piece (15) also arranged between a lowermost magnet, here (7*d*) and a substrate onto which it is attached, which may be the grille (11) at the air intake aperture (12).

FIG. 12 shows a combination of a fuel supply line (30) for fuel (1) provided with magnets (27*a, 27b, 27c*) arranged with opposite polarities adjacent to the fuel supply line, in addition to the first variant of a combustion air line (5), both running into a carburetor (31) for feeding a combustion chamber (4), or both supply lines (30) and (5) running directly into said combustion chamber (4).

FIG. 13 shows a combination of a fuel supply line (30) for fuel (1) provided with magnets (27*a*, 27*b*, 27*c*) arranged with opposite polarities adjacent to the fuel supply line, in addition to the variant of magnets arranged on a grille (11) on an air intake end opening (12) a combustion air intake pipe (5), both running into a combustion chamber (4) on a burner unit for heating some fluid, e.g water running in a coil (37) for being heated to form steam.

The device according to the invention may advantageously use magnets (7) comprising neodymium of a quality called N36, N34 or N38 due to field strength and temperature resistance, byt may otherwise use magnets comprising cobolt or strontium Experimental Results:

Two different prototype embodiments of the invention have been made for testing whether there is a reduction in fuel consumption or not One test has been conducted using a car under laboratory conditions, and an other test has been conducted using buses in ordinary traffic.

Laboratory Test Series of an Ordinary Car.

The laboratory test was conducted in three phases in an approved vehicle testing laboratory on an ordinary passenger car. The three phases comprised three test drive cycles in which the first set was called "A", in which no magnets were used, the second test was called "B" using magnets arranged according to the invention, and the third and, for the time being, preliminarily final test, was called "A" again, was conducted without magnets, and delayed for several thousand kilometers of ordinary use after the "B" tests. Fuel consumption and particle emissions were measured for all three sets "A", "B", and "A" tests, each comprising three test runs. The tests have been made by the independent test laboratory AVL MTC at Haninge in Stockholm, Sweden. Each test run is a simulation of a driving pattern of exactly defined accelerations and retardations, with driving speeds between 0 and 120 km/h, called a "European Driving Cycle" EDC, and conducted in the laboratory by trained pilots. Before testing, the car is taken inside the laboratory and having the fuel system cleaned and refilled with a reference fuel. The test car is then left overnight in the laboratory at a constant standard temperature of 22 C. before being tested. The test car used is a Volkswagen Passat TDI 1900 2003-model with automatic transmission. At the time of writing, two of the three phases have been reported from the AVL MTC laboratory, as cited in tables 1 and 2 below:

TABLE 1 particle emissions during test series "A" (without magnets) and "B" (with magnets)

| | | | | Consumption | | | Average | | |
|---|---|---|---|---|---|---|---|---|---|
| Date | km-reading | km | Arrangement | Total | City driving | "highway" driving | Total | City dr. | "highway" driving |
| 29.jul | 20 556 | | Without magnets | 0.7712 | 1.0811 | 0.5901 | 0.7596 | 1.0787 | 0.5727 |
| 30.jul | 20 626 | | Without magnets | 0.7519 | 1.0861 | 0.5563 | 0.7596 | 1.0787 | 0.5727 |
| 31.jul | 20 695 | | Without magnets | 0.7556 | 1.0688 | 0.5718 | 0.7596 | 1.0787 | 0.5727 |
| 19.aug | 23 710 | 3 000 | With magnets | 0.7180 | 0.9962 | 0.5522 | 0.7213 | 1.0031 | 0.5545 |
| 20.aug | 23 721 | 3 000 | With magnets | 0.7168 | 1.0020 | 0.5492 | 0.7213 | 1.0031 | 0.5545 |
| 21.aug | 23 850 | 3 000 | With magnets | 0.7292 | 1.0111 | 0.5622 | 0.7213 | 1.0031 | 0.5545 |
| | | | Without magnets | | | | 0.7596 | 1.0787 | 0.5727 |
| | | | With magnets | | | | 0.7213 | 1.0031 | 0.5545 |
| | | | Change in % | | | | −5.03% | −7.01% | −3.18% |

As can be seen from the left part of the sheet of FIG. 14, the fuel consumption is rather stable around the average consumption (in liters/10 km) of 0.7596 l/10 km, running without magnets in the first three runs in the Europe test "A". The city-drive part of the test is high, using in average 1.0787 l/10 km, and the "highway" part of the test is rather economically 0.5727 l/10 km. The average consumption for the three "B"-tests is significantly lower, 0.7213 l/10 km, a reduction of 5%, with the city-drive part reduced most, down to 1.0031 l/10 km representing a reduction of 7%, and the "highway" driving part reduced least, to 0.5545 l/10 km, a reduction of about 3%. The reduction in fuel consumption is stronger for the city-driving style.

TABLE 2 particle emissions during test series "A" (without magnets) and "B" (with magnets)

| Date | km reading | km | arrangement | particles | Average |
|---|---|---|---|---|---|
| 29.jul | 20 556 | | without magn. | 0.037 | 0.0360 |
| 30.jul | 20 626 | | without magn. | 0.037 | 0.0360 |
| 31.jul | 20 695 | | without magn. | 0.034 | 0.0360 |
| 19.aug | 23 710 | 3 000 | with magnets | 0.030 | 0.0323 |
| 20.aug | 23 721 | 3 000 | with magnets | 0.031 | 0.0323 |
| 21.aug | 23 850 | 3 000 | with magnets | 0.036 | 0.0323 |
| | | | without magn. | | 0.0360 |
| | | | with magnets | | 0.0323 |
| | | | Change in % | | −10.19% |

As can be seen from the right part of the sheet of FIG. 14, particle emissions during the "A" part of the test, without magnets, has an average of 0.0360. The average particle emissions during the "B" part of the test is reduced to 0.0323, a reduction of about 10%. This reduced particle emission may be a very important aspect for reducing pollution problems, particularly from large Diesel engines, like bus engines, construction machine engines, particularly in tunnels, and marine Diesel motors. Reduced particle emission is both a health advantage and may also result in cleaner exhaust emissions, as observed by some of the boats having magnets installed according to the invention.

Buses Tested Under Use in Ordinary Traffic

Another embodiment of the invention was arranged in ordinary diesel buses used on city lines of Gøteborgs Spårvägar in Gothenburg, Sweden. The test months were October 2002, January 2003, March 2003, April 2003, May 2003 and finally July 2003. Initially, 9 buses, bus no. 501, 502, 503,

504, 505, 506, 507, 508 and 510 were used in the experiment, and all continued up to May 2003, whereafter two buses, i.e. no. 503 and 505, went out of the experimental series for the last month. Magnets were arranged according to the invention on 3 Mar. 2003, and the results from that month period have been omitted from the graph due to the transition for bus no. 501, 502, 503, 505, and 508 from "without magnets" to "with magnets". For reasons unknown to us, the buses running without magnets up to 3 Mar. 2003 do have a higher average consumption before May 2003. However, the consumption remains almost unchanged (after a drop in May 2003) after having magnets arranged in march. Contrarily, the consumption for buses without magnets during the entire test increases sharply after May 2003.

Table. 3: Diesel consumption in l/10 km for 9 buses, with and without magnets.

TABLE 3

| Bus no. | Liter | km * 10 | October 2002 l/10 km | Liter | km * 10 | January 2003 l/10 km | Liter | km * 10 | March 2003 l/10 km |
|---|---|---|---|---|---|---|---|---|---|
| A501 | 3005 | 817 | 3.68 | 1740 | 443 | 3.93 | 2965 | 851 | 3.49 |
| A502 | 3591 | 944 | 3.80 | 1910 | 523 | 3.65 | 3406 | 871 | 3.91 |
| A503 | 3431 | 846 | 4.06 | 2279 | 510 | 4.47 | 2849 | 664 | 4.29 |
| A504 | 2891 | 809 | 3.57 | 1245 | 468 | 2.66 | 2955 | 831 | 3.56 |
| A505 | 3289 | 937 | 3.51 | 1580 | 478 | 3.31 | 2949 | 826 | 3.57 |
| A506 | 2504 | 799 | 3.13 | 1774 | 484 | 3.66 | 2787 | 815 | 3.42 |
| A507 | 2503 | 688 | 3.64 | 2021 | 498 | 4.06 | 3142 | 814 | 3.88 |
| A508 | 3007 | 758 | 3.97 | 2441 | 570 | 4.29 | 3071 | 772 | 3.98 |
| A510 | 2338 | 726 | 3.22 | 2311 | 573 | 4.04 | 3392 | 908 | 3.74 |
| Sum with | 10236 | 3022 | 3.39 | 7351 | 2023 | 3.63 | 7351 | 2023 | 3.63 |
| Sum with | 16323 | 4301 | 3.80 | 9950 | 2524 | 3.94 | 9950 | 2524 | 3.94 |

| Bus no. | Liter | km * 10 | April 2003 l/10 km | Liter | km * 10 | May 2003 l/10 km |
|---|---|---|---|---|---|---|
| A501 | 2722 | 754 | 3.61 | 3366 | 878 | 3.83 |
| A502 | 2565 | 765 | 3.35 | 3216 | 791 | 4.07 |
| A503 | 3022 | 825 | 3.66 | 2905 | 842 | 3.45 |
| A504 | 3025 | 894 | 3.38 | 3280 | 813 | 4.03 |
| A505 | 2335 | 743 | 3.14 | 3490 | 906 | 3.85 |
| A506 | 2430 | 695 | 3.50 | 1990 | 551 | 3.61 |
| A507 | 2702 | 774 | 3.49 | 2764 | 670 | 4.13 |
| A508 | 2387 | 734 | 3.25 | 3082 | 767 | 4.02 |
| A510 | 2858 | 758 | 3.77 | 3231 | 826 | 3.91 |
| Sum with | 12276 | 3368 | 3.65 | 11015 | 3121 | 3.53 |
| Sum with | 15240 | 3983 | 3.83 | 13031 | 3821 | 3.41 |

The invention claimed is:

1. A device for pre-conditioning of combustion air at a combustion air inlet path (2) to a combustion chamber (4), in which said inlet comprises a set (6) of two or more magnetic fields (8*a*, 8*b*, . . . ) arranged along said inlet path (2), each of said magnetic field (8*a*) having a corresponding north pole (Na, Nb, . . . ) and a corresponding south pole (Sa, Sb, . . . ) and a general magnetic moment vector (10*a*, 10*b*, . . . ) extending from said south pole portion (Sa, Sb, . . . ) to said north pole (Na, Nb, );

said magnetic moment vectors (10*a*, 10*b*, . . . ) being arranged mainly perpendicularly with respect to a longitudinal axis of said combustion air inlet path (2);

said magnetic moment vectors (10*a*, 10*b*, . . . ) being distributed consecutively along said combustion air inlet path (2);

said magnetic moments arranged with a separation between each said consecutive magnetic moment vector;

said second or consecutive magnetic field (8*b*) being arranged having said second or consecutive magnetic moment vector's (10*b*, . . . ) pole (Nb, Sb, . . . ) with the opposite pole adjacent to said inlet path (2) with respect to said first or preceding magnetic moment vector's (10*a*, . . . ) pole (Sa, Na, . . . ).

2. The device of claim 1, said combustion air inlet path (2) being through an inlet channel or pipe (5), said magnetic moment vectors (10*a*, 10*b*, . . . ) comprising permanent magnets (7*a*, 7*b*, . . . ) arranged on a wall of said pipe (5), said magnets being spaced apart from each other by a separation space.

3. The device of claim 2, said permanent magnets (7*a*, 7*b*, . . . ) arranged on the outer surface of said pipe (5).

4. The device of claim 2, said permanent magnets (7*a*, 7*b*, . . . ) arranged on an inner surface of said pipe (5).

5. The device of claim 2, said permanent magnets (7*a*, 7*b*, . . .) arranged inside the wall of said pipe (5).

6. The device of claim 2, said pipe (5) having a flattened section (5*s*) and having said permanent magnets (7*a*, 7*b*, . . .) arranged on said flattened section (5*s*).

7. The device of claim 1, said first and second magnetic moments forming an angle (a) between 180 degrees and 120 degrees as seen along said combustion air inlet path (2), in a plane (p) perpendicular to said combustion air inlet path (2).

8. The device of claim 1, said combustion air inlet path (2) being through an inlet channel or pipe (5), said magnetic moment vectors (10*a*, 10*b*, . . . ) comprising permanent magnets (7*a*, 7*b*, . . . ) arranged on the wall of said pipe (5).

9. The device of claim 1, in which said magnetic moments (10,20) comprise electric current coils in which an electric current contributes to form said magnetic moment.

10. The device of claim 1, in which said magnets (7) are made using neodymium.

11. A device for pre-conditioning of combustion air at a combustion air inlet path (2) to a combustion chamber (4), in which said inlet comprises a set (6) of two or more magnetic fields (8*a*, 8*b*, . . . ) arranged along said combustion air inlet path (2);

each said magnetic field (8*a*) having a general magnetic moment vector (10*a*, 10*b*, . . . ) extending from said south pole portion (Sa, Sb, . . . ) to said north pole (Na, Nb, . . . ); characterized in that said magnetic moment vectors (10*a*, 10*b*, . . . ) being arranged mainly perpendicularly with respect to a longitudinal axis of said combustion air inlet path (2);

said magnetic moment vectors (10*a*, 10*b*, . . . ) being distributed consecutively along said combustion air inlet path (2);

said magnetic moments arranged with a separation between each said consecutive magnetic moment vector;

said first and second magnetic moments forming an angle (a) between 180° degrees and 60° degrees as seen along said combustion air inlet path (2), in a plane (p) perpendicular to said inlet path (2).

12. A device for pre-conditioning of combustion air at a combustion air inlet path (2) to a combustion chamber (4), in which said inlet comprises a set (6) of two of more magnets producing two or more magnetic fields (8*a*, 8*b*, . . . ) arranged along said combustion air inlet path (2), each of said magnetic field (8*a*) having a corresponding north pole (Na, Nb, . . . ) and a corresponding south pole (Sa, Sb, . . . ) and a general magnetic moment vector (10*a*, 10*b*, . . . ) extending from said south pole portion (Sa, Sb, . . . ) to said north pole (Na, Nb, . . . ) ; characterized in that said magnetic moment vectors (10*a*, 10*b*, . . . ) being arranged mainly perpendicularly with respect to a longitudinal axis of said combustion air inlet path (2), said combustion air inlet path (2) leading through an aperture (12) at an inlet end of an air pipe (5);

said magnetic moment vectors (10*a*, 10*b*, . . . ) being distributed consecutively along said combustion air inlet path (2);

said magnets arranged in a spaced apart relationship with said magnetic moments arranged with a separation between each said consecutive magnetic moment vector;

said second or consecutive magnetic field (8*b*) being arranged having said second or consecutive magnetic moment vector's (10*b*, . . . ) pole (Nb, Sb, . . . ) with the opposite pole adjacent to said combustion air inlet path (2) with respect to said first or preceding magnetic moment vector's (10*a* , . . . ) pole (Sa, Na, . . . ).

13. The device of claim 12, in which said magnetic moment vectors (10*a*, 10*b*, . . . ) being arranged parallel to a mesh or grille (11) covering said aperture (12) to said inlet end of said inlet pipe (5).

14. The device of claim 13, in which said magnetic moment vectors (10*a*, 10*b*) arranged as one or more groups of two or more magnets (7*a*, 7*b*, 7*c*, . . . ) arranged on said grille (12), having said magnet (7*a*) arranged on top of said magnet (7*b*), and said lowermost magnet (7*b*, 7*c*, . . . ) arranged on said grille (11).

15. The device of claim 14, with a separator piece (15) of non-magnetic material arranged between said magnets (7*a*, 7*b*).

16. The device of claim 14, with a separator piece (15) of non-magnetic material arranged between said lowermost magnet (7*b*, 7*c*, . . . ) and said grille (12).

17. The device of claim 13, in which said inlet (12) of said inlet pipe is an axial inlet and in which said grille is a plate-shaped grille covering said inlet (12).

18. The device of claim 13, in which said inlet (12) of said inlet pipe is a radial inlet and in which said grille is a cylinder-sidewall or sleeve-shaped grille covering said inlet (12), one end of said sleeve being connected to the inlet end of said inlet pipe (5), and an opposite end of said sleeve being covered by a plate (13).

* * * * *

UNITED STATES PATENT AND TRADEMARK OFFICE

CERTIFICATE OF CORRECTION

PATENT NO. : 7,650,877 B2
APPLICATION NO. : 10/571676
DATED : January 26, 2010
INVENTOR(S) : Thalberg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 334 days.

Signed and Sealed this

Twenty-eighth Day of December, 2010

David J. Kappos

David J. Kappos
*Director of the United States Patent and Trademark Office*